United States Patent [19]

Mitani et al.

[11] Patent Number: 5,059,087

[45] Date of Patent: Oct. 22, 1991

[54] BOBBIN CONVEYING SYSTEM

[75] Inventors: Yoshio Mitani, Kani; Takenori Yanai, Inuyama, both of Japan

[73] Assignee: Murata Kikai Kabushiki Kaisha, Kyoto, Japan

[21] Appl. No.: 523,664

[22] Filed: May 15, 1990

[30] Foreign Application Priority Data

May 15, 1989 [JP] Japan ..... 1-55521[U]
May 15, 1989 [JP] Japan ..... 1-120649

[51] Int. Cl.[5] ..... B65G 65/00

[52] U.S. Cl. ..... 414/626; 242/35.5 A; 294/87.1; 414/908; 414/911

[58] Field of Search ..... 414/609, 626, 908, 910, 414/911; 294/87.1, 81.51, 81.61, 87.22, 87.24; 242/35.5 A

[56] References Cited

U.S. PATENT DOCUMENTS

| | | | |
|---|---|---|---|
| 2,711,832 | 6/1955 | Cigliano | 414/609 X |
| 2,718,426 | 9/1955 | Nagy | 294/87.1 |
| 3,022,551 | 2/1962 | Marburg | 294/87.1 |
| 3,086,668 | 4/1963 | Krupp et al. | 294/87.1 X |
| 3,179,460 | 4/1965 | Gunzelmann | 294/81.61 X |
| 3,680,907 | 8/1972 | Sregwart | 414/626 X |
| 4,555,067 | 11/1985 | Angelucci et al. | 242/35.5 A |
| 4,610,404 | 9/1986 | Maccaferi | 242/35.5 A X |
| 4,615,493 | 10/1986 | Teranishi et al. | 242/35.5 A |
| 4,682,929 | 7/1987 | Kataoka | 414/911 X |
| 4,708,574 | 11/1987 | Conboy et al. | 414/908 X |
| 4,723,884 | 2/1988 | Brinker et al. | 414/908 X |
| 4,783,021 | 11/1988 | Nagasawa | 414/908 X |
| 4,940,127 | 7/1990 | Kikechi et al. | 242/35.5 A X |
| 4,941,798 | 7/1990 | Meier | 414/908 X |
| 5,003,762 | 4/1991 | Scaglia | 242/35.5 A X |

FOREIGN PATENT DOCUMENTS

| | | | |
|---|---|---|---|
| 1456480 | 10/1969 | Fed. Rep. of Germany | 294/87.1 |
| 10231 | 2/1982 | Japan | 294/87.24 |
| 19231 | 2/1982 | Japan | 294/87.24 |
| 244803 | 10/1987 | Japan | 414/908 |
| 214995 | 3/1967 | Sweden | 249/87.1 |
| 1201148 | 12/1985 | U.S.S.R. | 294/87.1 |

*Primary Examiner*—David A. Bucci
*Attorney, Agent, or Firm*—Spensley Horn Jubas & Lubitz

[57] ABSTRACT

A bobbin conveying system includes an automatic travelling car for conveyance of spinning and empty bobbins, a station for carrying out a spinning bobbin to the automatic travelling car and carrying in an empty bobbin from the car, and a station for carrying in a spinning bobbin from the automatic travelling car and carrying out an empty bobbin to the car, the spinning and empty bobbins carrying-in and -out operations being performed simultaneously at both the stations.

3 Claims, 12 Drawing Sheets

BOBBIN CONVEYING SYSTEM

FIELD OF THE INVENTION

The present invention relates to a bobbin conveying system and particularly to a bobbin conveying system for performing the conveyance of spinning bobbins and empty bobbins efficiently.

RELATED ART STATEMENT

In a spinning mill or the like, yarn as a semi-finished product is often conveyed to the next step in a wound-up form around a bobbin by means of an overhead travelling car for example. In this case, a system is provided whereby a spinning bobbin with yarn wound thereon is conveyed from a spinning bobbin carrying-out station to a spinning bobbin carrying-in station, while an empty bobbin from which yarn has been unwound is conveyed from an empty bobbin carrying-out station to an empty bobbin carrying-in station. That is, in a certain step yarn is wound round an empty bobbin and the resulting spinning bobbin is sent out, then in the next step the yarn on the spinning bobbin is unwound and the resulting empty bobbin is returned again to the preceding step. For this conveyance, four carrying-in and -out stations have heretofore been used.

According to such a conventional bobbin conveying system, at least four bobbin carrying-in and -out stations are required. Such a system will accordingly occupy a large space in a factory. Further, the overhead travelling car repeats stop and start at four places where it is necessary to conduct the bobbin transfer operations, thus wasting time and labor.

In a factory or a warehouse, yarn or sheet-like goods are often conveyed in a rolled form by means of an overhead travelling car or the like. In this case, for the transfer of a roll-like work such as a spinning bobbin (lap) with yarn wound thereon from station to station, equipment for holding a work is mounted to the overhead travelling car, and the transfer of the work between each station and the overhead travelling car is performed using a holding mechanism and a lift mechanism.

For conveying a plurality of roll-like works at a time it has heretofore been necessary to provide a plurality of work holding mechanisms. According to the prior art, moreover, a dedicated drive source is provided for each of such plural work holding mechanisms.

In the case where a drive source for driving a work holding mechanism is provided for each of plural work holding mechanism, it is necessary to control, adjust and provide maintenance for each of the drive sources. This is not only complicated but also requires a complex wiring for power supply, etc.

OBJECT AND SUMMARY OF THE INVENTION

Taking note of the fact that the spinning bobbin carrying-out place and the empty bobbin carrying-in place are in proximity to each other, and the spinning bobbin carrying-in place and the empty bobbin carrying-out place are in proximity to each other, the present invention has for its object the provision of a bobbin conveying system of simple construction for efficient conveyance of spinning bobbins and empty bobbins.

The present invention has for another object the provision of work holding equipment for an overhead travelling car which is simple in structure and easy to handle.

According to the present invention, for achieving the above-mentioned object, there is provided a bobbin conveying system including an automatic travelling car for the conveyance of spinning and empty bobbins; a station for carrying out a spinning bobbin to the automatic travelling car and carrying in an empty bobbin from the car; and a station for carrying in a spinning bobbin from the automatic travelling car and carrying out an empty bobbin to the car, the spinning and empty bobbins carrying-in and -out operations being performed simultaneously at both stations.

Since the present invention is constructed as above, it exhibits the following functions.

According to the present invention, although four stations have heretofore been required, the spinning bobbin carrying-out and empty bobbin carrying-in operations are performed by one station, while the spinning bobbin carrying-in and empty bobbin carrying-out operations are performed by one station, whereby the number of stations is decreased to reduce the number of times of start and stop of the automatic travelling car; further, since the spinning and empty bobbins carrying-in and -out operations are performed simultaneously, it is possible to save labor and time and attain efficient operation of the system. It is also possible to prevent unloaded travelling of the automatic travelling car.

According to the present invention, in order to achieve the above-mentioned second object there is provided work holding equipment for an overhead travelling car to convey a plurality of roll-like works, the work holding equipment including a single actuator and a plurality of holding mechanisms which are driven interlockedly by the actuator, the holding mechanisms being rotatable substantially from a vertical direction to a horizontal direction.

Since the present invention is constructed as above, it exhibits the following effects.

According to the present invention, there is used only one actuator although plural actuators have heretofore been used for holding plural roll-like works, and plural work holding mechanisms are driven interlockedly by the actuator. Consequently, the control and adjustment of the work holding mechanisms are simplified and facilitated. Besides, the wiring equipment for power supply and control which has heretofore been necessary for each actuator is no longer necessary, and so the structure is simplified. Further, since the work holding mechanisms are each rotatable substantially from a vertical direction to a horizontal direction, the width of each work holding portion may be approximately equal to that of work, so that the reduction in size of the entire equipment can be attained.

DETAILED DESCRIPTION OF PREFERRED EMBODIMENT

Figure 1:
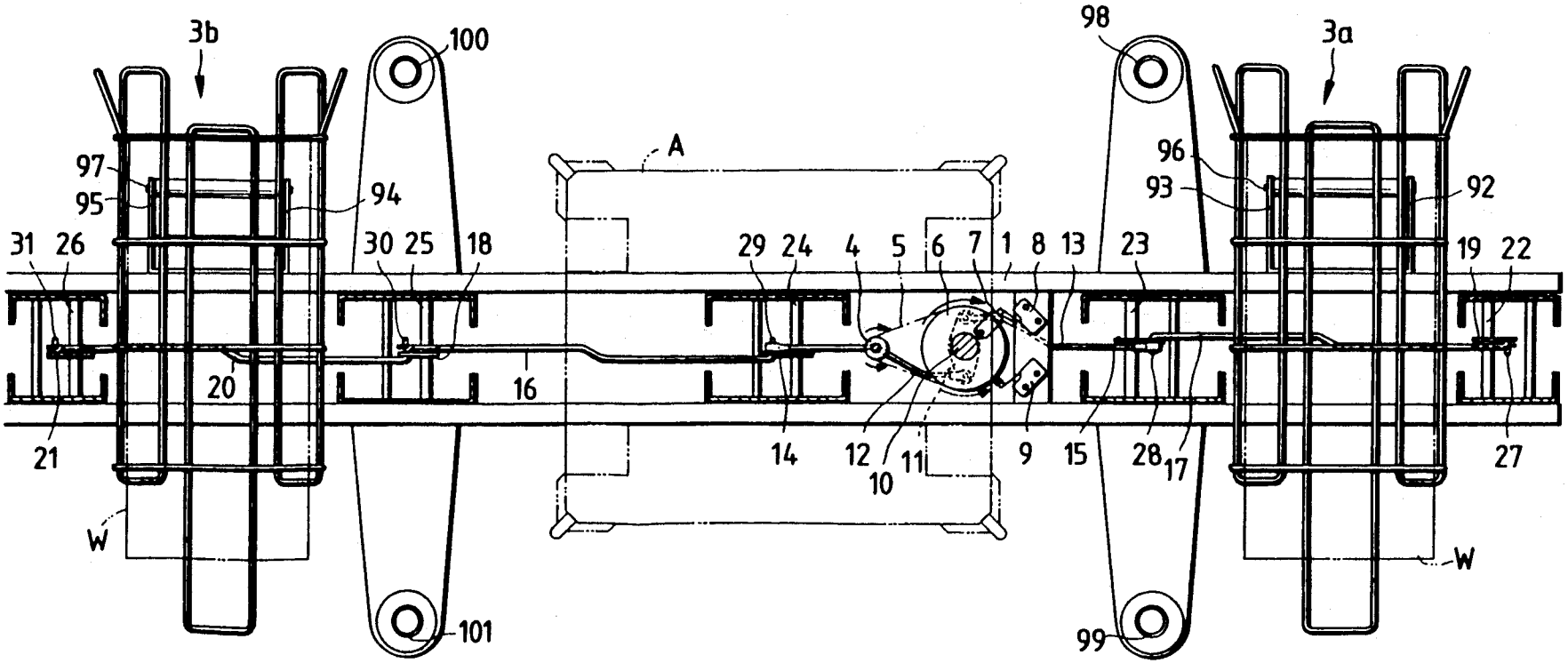
FIG. 1 is a plan view showing a bobbin carrier mounted to an overhead travelling car which is utilized in the bobbin conveying system of the present invention.
Figure 2:
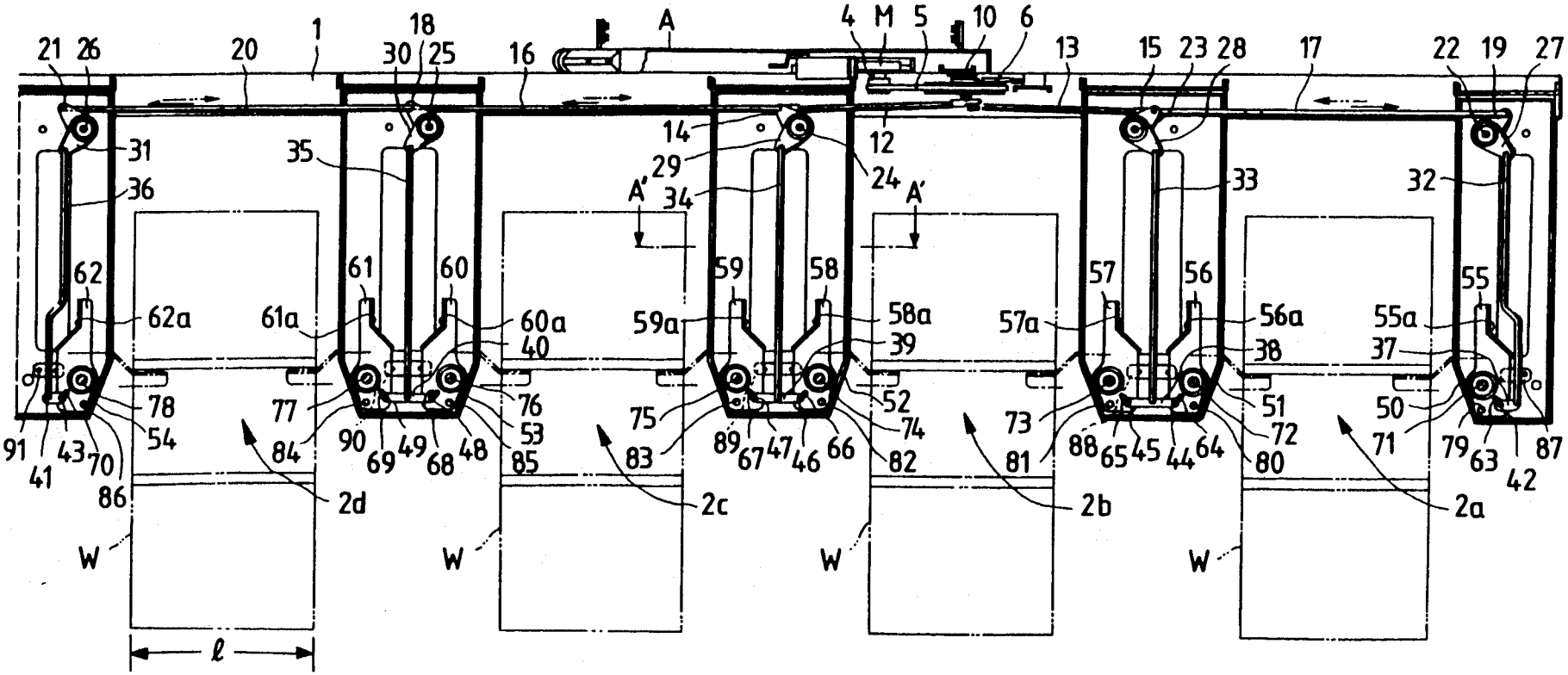
FIG. 2 is a front view of the said bobbin carrier.
Figure 3:
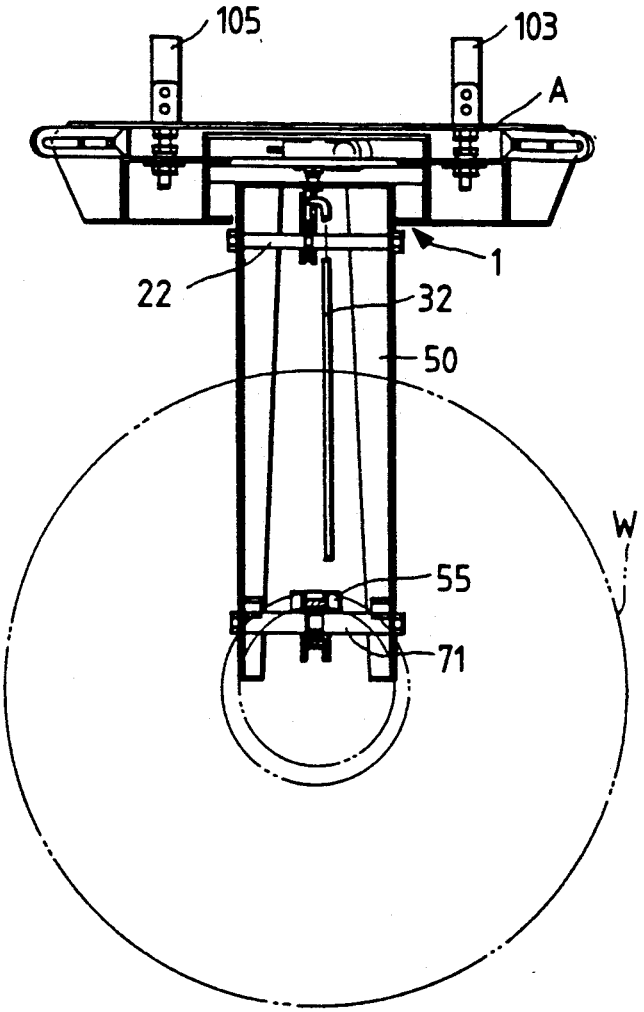
FIG. 3 is a side view showing a spinning bobbin receiving portion of the said bobbin carrier.
Figure 4:
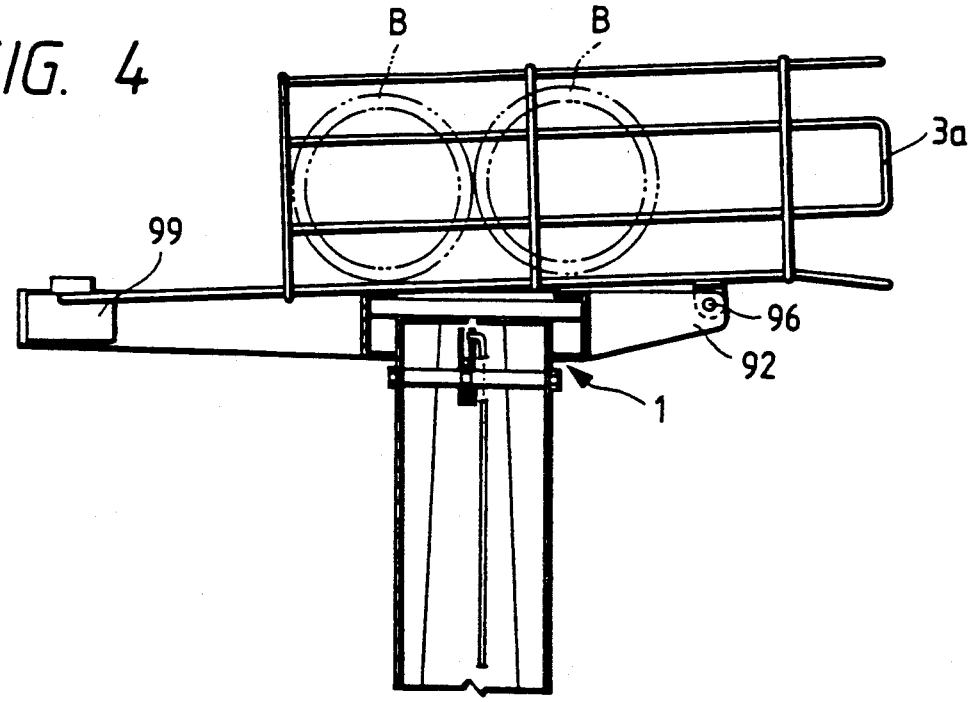
FIG. 4 is a side view showing an empty bobbin receiving portion of the said bobbin carrier.

An embodiment of the present invention which is illustrated in the drawings will be described hereinunder.

FIGS. 1 to 4 illustrate an embodiment of the present invention in which a carrier of an overhead travelling car which is utilized in a bobbin conveying system.

In those figures, a bobbin carrier 1 is fixed to a lift base A of the overhead travelling car. The bobbin carrier 1 holds four spinning bobbins (laps) W through four holding portions *2a, 2b, 2c* and *2d* which are provided in the lower portion of the bobbin carrier 1. Near both ends of the upper surface of the bobbin carrier 1 there are provided baskets *3a* and *3b* each capable of receiving two empty bobbins B therein.

The bobbin carrier 1 contains a motor M to drive the spinning bobbin W holding mechanism. A belt 5 is wound round a driving pulley 4 of the motor M to rotate a driven pulley 6. To the upper surface of the driven pulley 6 is attached a limit plate 7, and the rotation of the driven pulley 6 is limited by limit switches 8 and 9. More specifically, the driven pulley 6 rotates only about 90 degrees which is the angle between the limit switches 8 and 9.

The driven pulley 6 is fixed onto a shaft 10, and under the driven pulley 6 a crank 11 is fixed to the shaft 10 so that it is interlocked with the driven pulley 6. One end of two connecting rods 12 and 13 are mounted rotatably to the crank 11 in positions opposed to each other. The other ends of the connecting rods 12 and 13 are mounted rotatably to cranks 14 and 15, respectively. To the cranks 14 and 15 are rotatably mounted ends of connecting rods 16 and 17, respectively, while to the other ends of the connecting rods 16 and 17 there are mounted cranks 18 and 19 rotatably. Further, one end of a connecting rod 20 is mounted rotatably to the crank 18, while the other end thereof is rotatably mounted to a crank 21.

The cranks 14, 15, 18, 19 and 21 are fixed to crank shafts 22–26, to which are also fixed cranks 27–31 so as to intersect the cranks 14, 15, 18, 19 and 21 perpendicularly and in an interlocked relation. To the cranks 27–31 there are rotatably mounted one ends of connecting rods 32–36, while to the other ends thereof there are mounted crossheads 37–41.

Out of the crossheads, the crossheads 37 and 41 positioned at both ends are provided with pins 42 and 43, respectively. The crosshead 38 which is an intermediate crosshead is provided with two pins 44 and 45 at both ends thereof respectively. The other intermediate crossheads 39 and 40 are also provided with similar pins 46, 47, 48 and 49.

The pins 42–49 are loosely fitted in sliding slots 63–70 formed in the rear ends of holding pieces 55–62 adapted to project to the holding portions *2a–2d* which are defined by five depending portions 50–54, to hold spinning bobbins W. The holding pieces 55–62 are mounted to the depending portions 50–54 pivotably through shafts 71–78.

Figure 5:
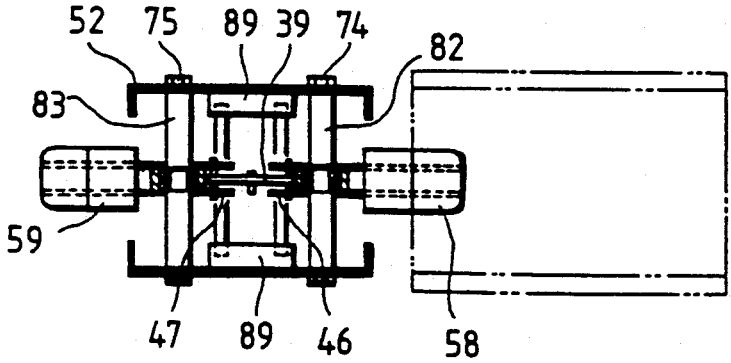
FIG. 5 is a view as seen in the direction of A'—A' in FIG. 2.

In the holding pieces 55–62, as best shown in FIG. 5, stopper pins 79–86 are provided projectingly in the transverse direction below the sliding slots 63–70 so that they come into abutment with stoppers 87–91 fixed to both inner surfaces of the depending portions 50–54.

The baskets *3a* and *3b* provided on the upper surface of the bobbin carrier 1 for receiving empty bobbins therein are mounted pivotably to shafts 96 and 97 extending respectively between brackets 92 and 93 and between brackets 94 and 95. The baskets *3a* and *3b* are slightly inclined leftwards in FIG. 4 and its left end face is closed, while its right end face is open. The empty bobbin B is very light-weight as compared with the spinning bobbin, so it is not necessary to use such a strong mechanism as the spinning bobbin holding equipment illustrated. In this embodiment, therefore, the spinning bobbin holding mechanism is not used for holding an empty bobbin, but instead there are separately provided the baskets *3a* and *3b* for receiving empty bobbins therein to thereby attain more efficient operations and more simplified operation control.

Numerals 98 to 101 denote guide holes for insertion therein of guide rods, which guide holes are formed in bobbin carrying-in and -out stations so that the bobbin carrier can be positioned accurately. The guide holes 98–101 are conically open downwards to facilitate the insertion of guide rods therein.

Figure 6:
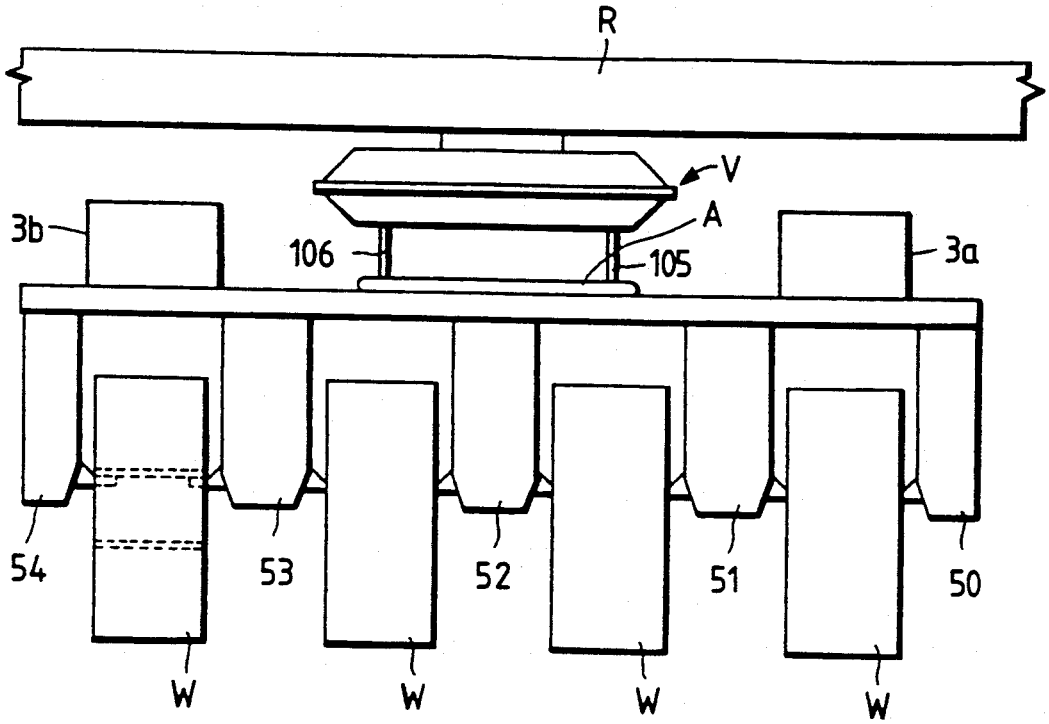
FIG. 6 is a front view showing the bobbin carrier in a spinning bobbin holding state as well as the overhead travelling car.

FIG. 6 shows an overhead travelling car V with the bobbin carrier 1 mounted thereto while holding the spinning bobbins W.

As shown in the same figure, the overhead travelling car V travels along a rail R suspended from the ceiling, and four belts 103–106 (104 not shown) connected to the lift base A are wound up or down by means of a lift mechanism provided within a travelling car body 102, whereby the lift base A and the bobbin carrier 1 fixed to the lift base A are moved vertically.

The operation of the bobbin carrier 1 will be described below.

When the motor M of the bobbin carrier 1 is operated in a dash-double dot line arrow direction to turn the driven pulley 6 in that direction, the crank 11 is interlocked with this motion and pulls the connecting rods 12 and 13, so that the connecting rods 12 and 13 move rightwards and leftwards, respectively. The connecting rods 12, 16 and 20 move rightwards interlockedly through the cranks 14 and 18, while the connecting rods 13 and 17 move leftwards through the crank 15. Consequently, the cranks 14, 15, 18, 19 and 21 turn about 90 degrees in the dash-double dot line arrow direction.

Figure 7:
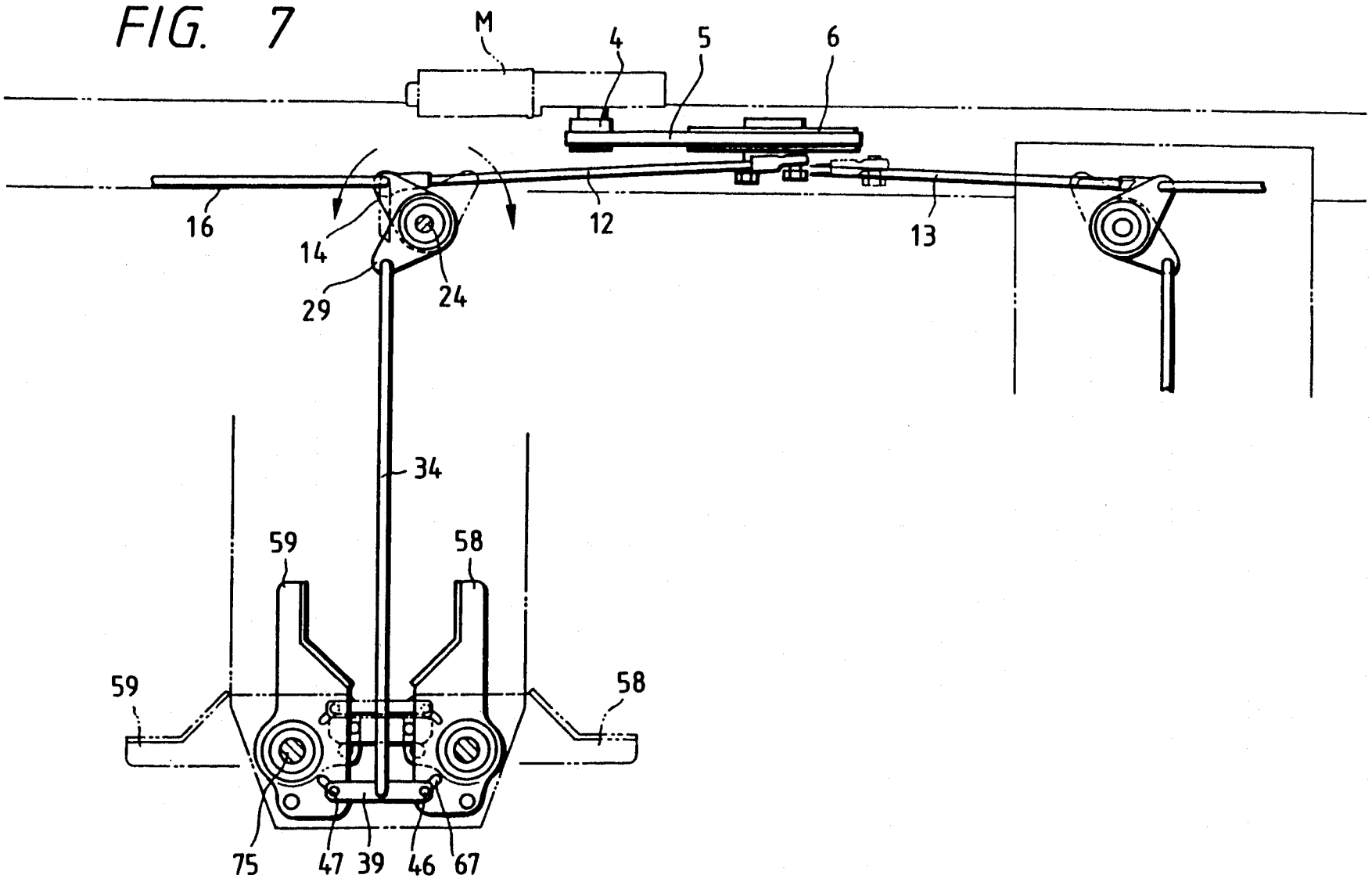
FIG. 7 is a view explanatory of operation, showing part of a spinning bobbin holding mechanism of the bobbin carrier.

Upon turning of the cranks 14, 15, 18, 19 and 21, the cranks 27–31 also turn interlockedly. The following description is now provided about the holding mechanism in the depending portion 52 with reference to FIG. 7.

When the crank 29 turns interlockedly upon rotation of the crank 14, the connecting rod 34 is pulled upwards and moves. The crosshead 39 at an end portion of the connecting rod 34 also moves upwards. The holding pieces 58 and 59 move from the solid line positions to the dash-double dot line positions thereof pivotally about the pins 46 and 47, while the stopper pins 82 and 83 come into abutment with the stopper 89 and stop, so that the holding pieces can support and bear the load of the spinning bobbin W.

If the motor M rotates in the reverse direction (solid line direction) when the above members are in the respective positions mentioned above, the connecting rod 12 is pushed and moves leftwards, and the connecting rod 34 is also pushed downwards and depresses the crosshead 39, so that the holding pieces 58 and 59 revert to the respective original positions indicated by solid lines.

Also in the holding mechanisms of the depending portions 50, 51, 53 and 54 there are performed the same operations as above. Thus, the holding mechanisms of the bobbin carrier 1 in the embodiment comprising plural connecting rods and cranks in a combined fashion do not require plural driving sources but are driven simultaneously by means of a single motor M. Therefore, it is easy to control the bobbin holding operation and it is possible to save motor, wiring, etc.

The holding pieces 55–62 have holding surfaces **55*a*–62*a* of a shape such that when they assume a posture of holding spinning bobbins W, the portions near the front ends of the holding surfaces are horizontal, while the portions near the depending portions 50–54 are inclined. In the four sets of opposed holding pieces 55–56, 57–58, 59–60, and 61–62**, the distance from the boundary of the horizontal and inclined surfaces of one holding piece to such boundary of another holding piece is equal to the length, l, of bobbin B. Therefore, each spinning bobbin W can be held and released in extract posture and position.

Figure 8:
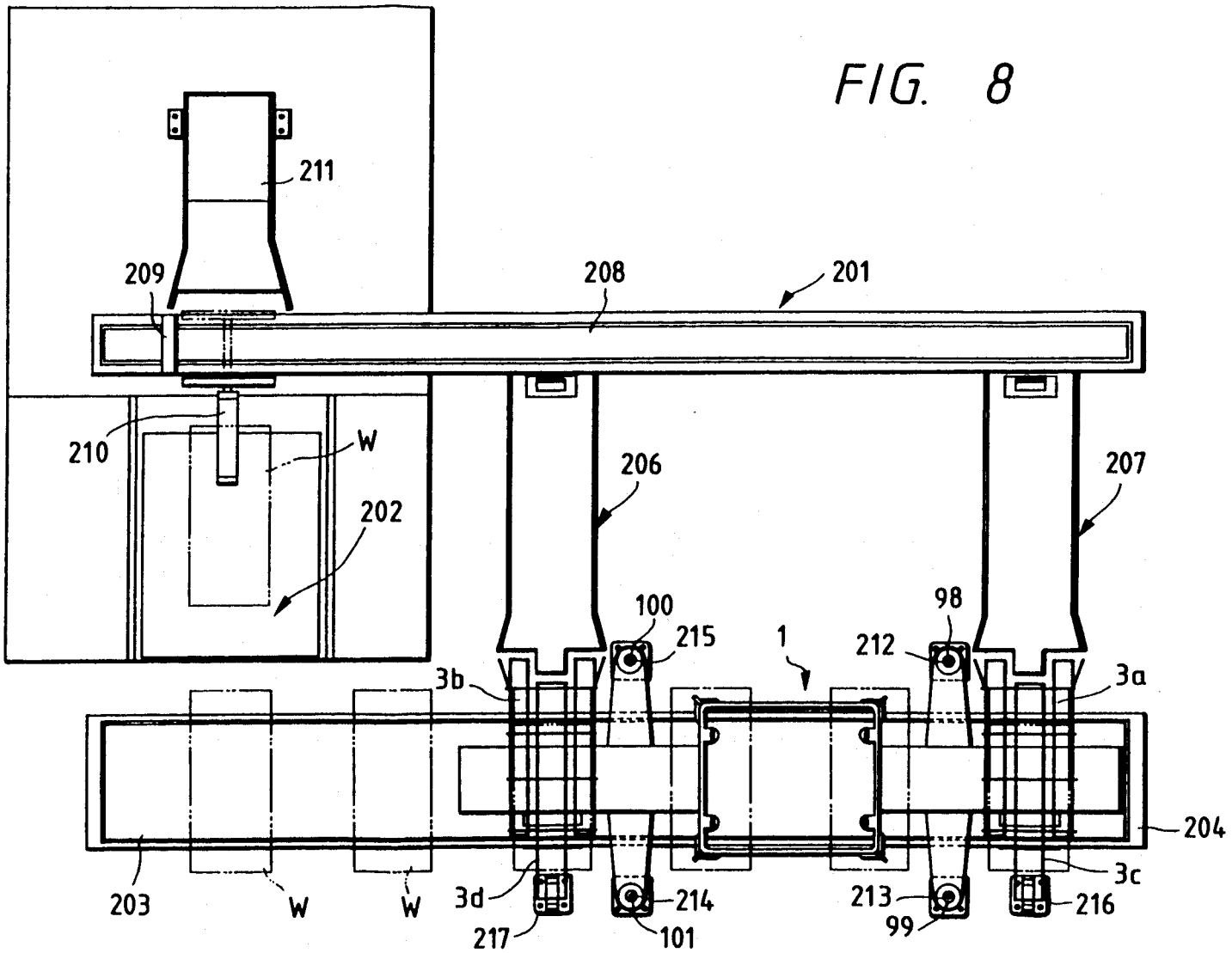
FIGS. 8, 9 and 10 are a plan view, a front view and a side view, respectively, showing a spinning bobbin carrying-out/empty bobbin carrying-in station which is utilized in the bobbin conveying system of the present invention.
Figure 9:
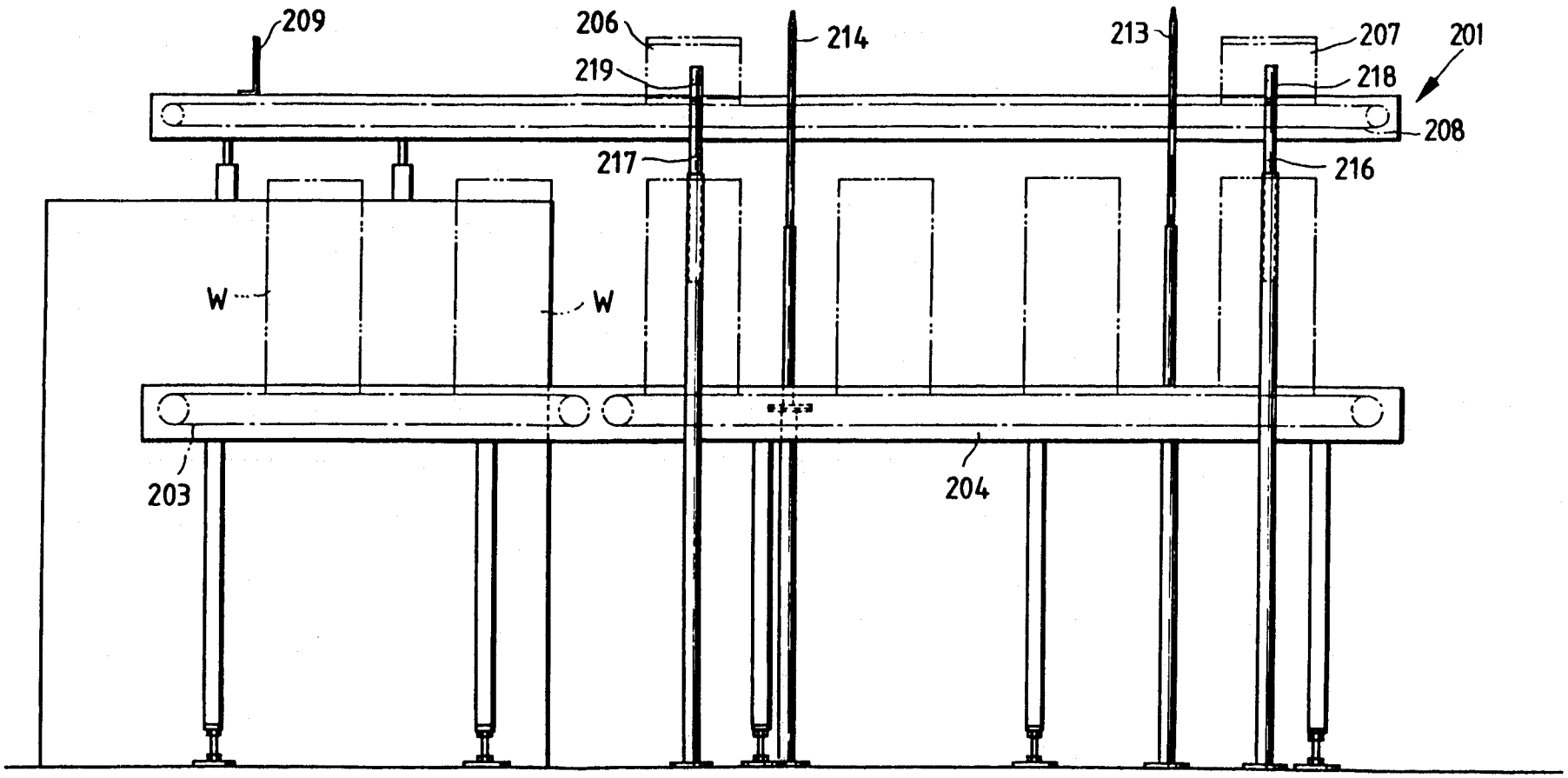
Figure 10:
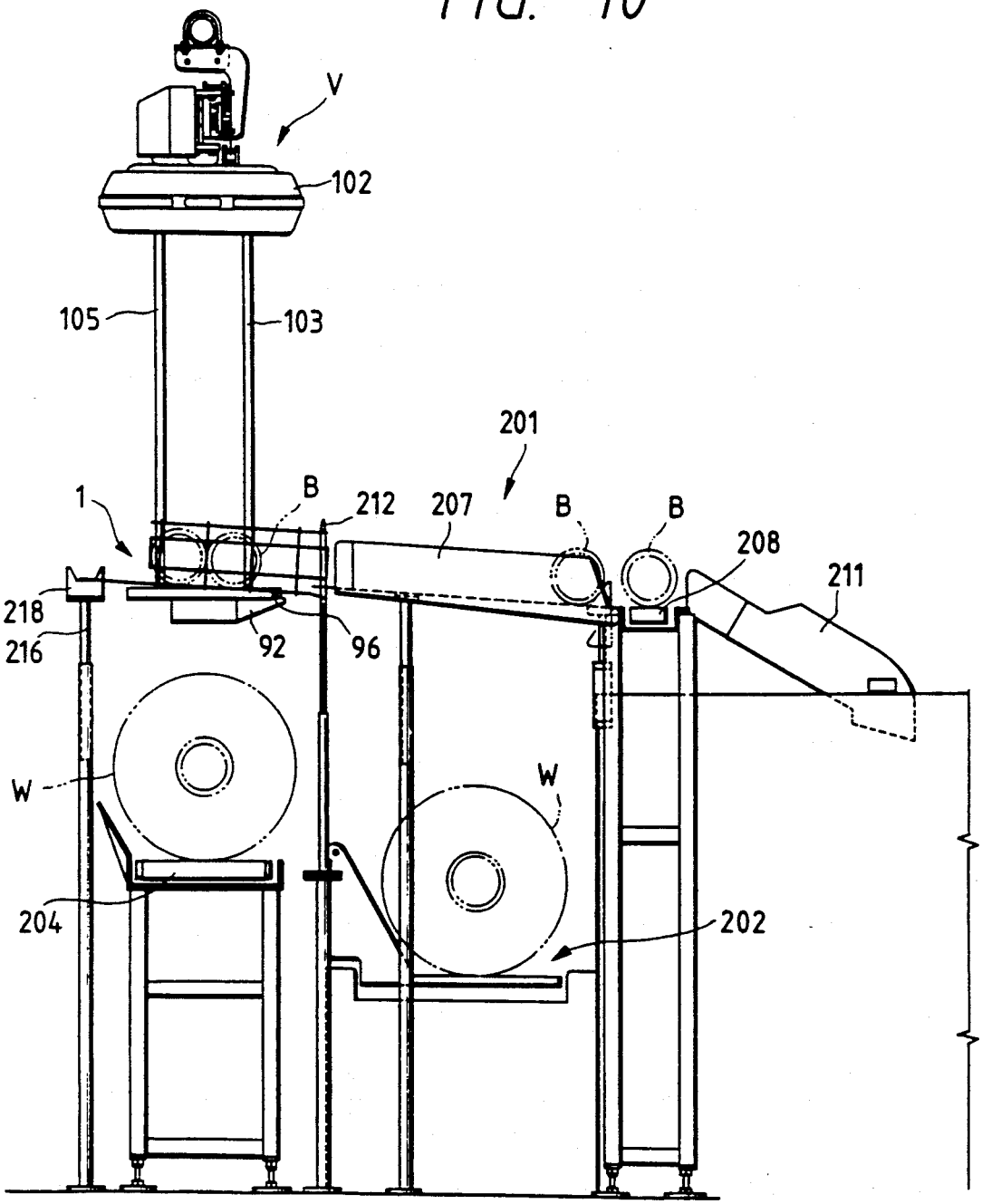
Figure 11:
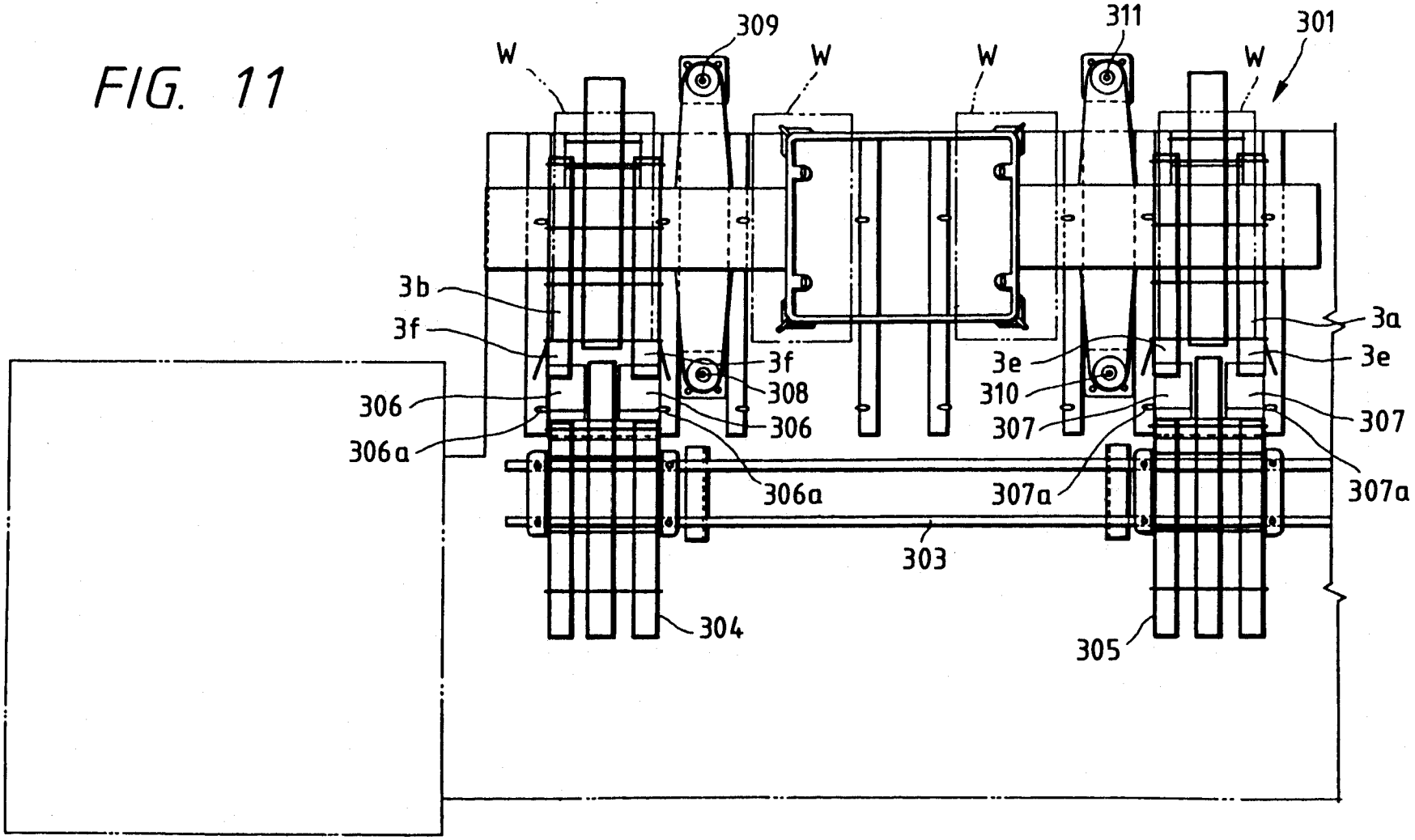
FIGS. 11, 12 and 13 are a plan view, a front view and a side view, respectively, showing a spinning bobbin carrying-in/empty bobbin carrying-out station which is utilized in the bobbin conveying system of the present invention.
Figure 12:
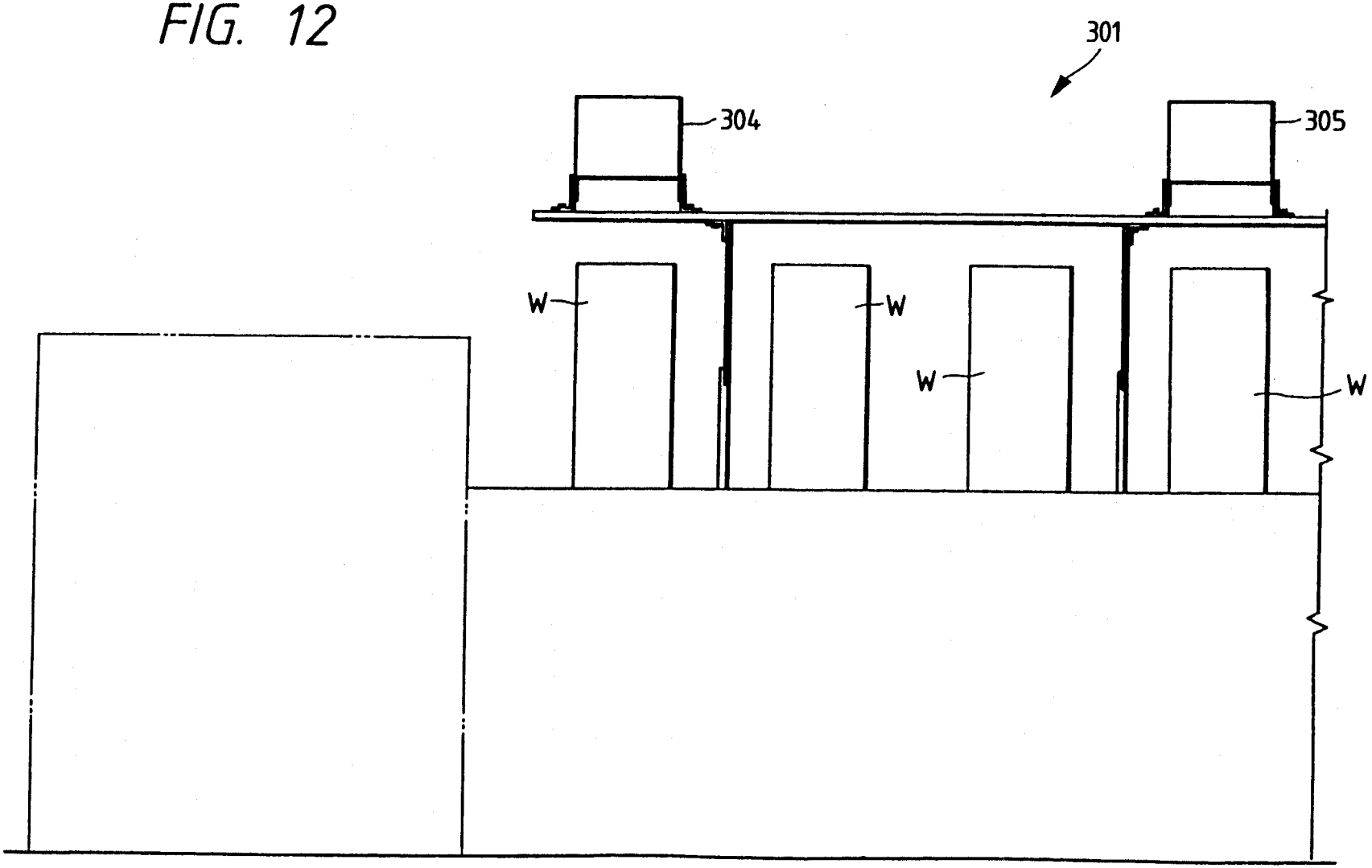
Figure 13:
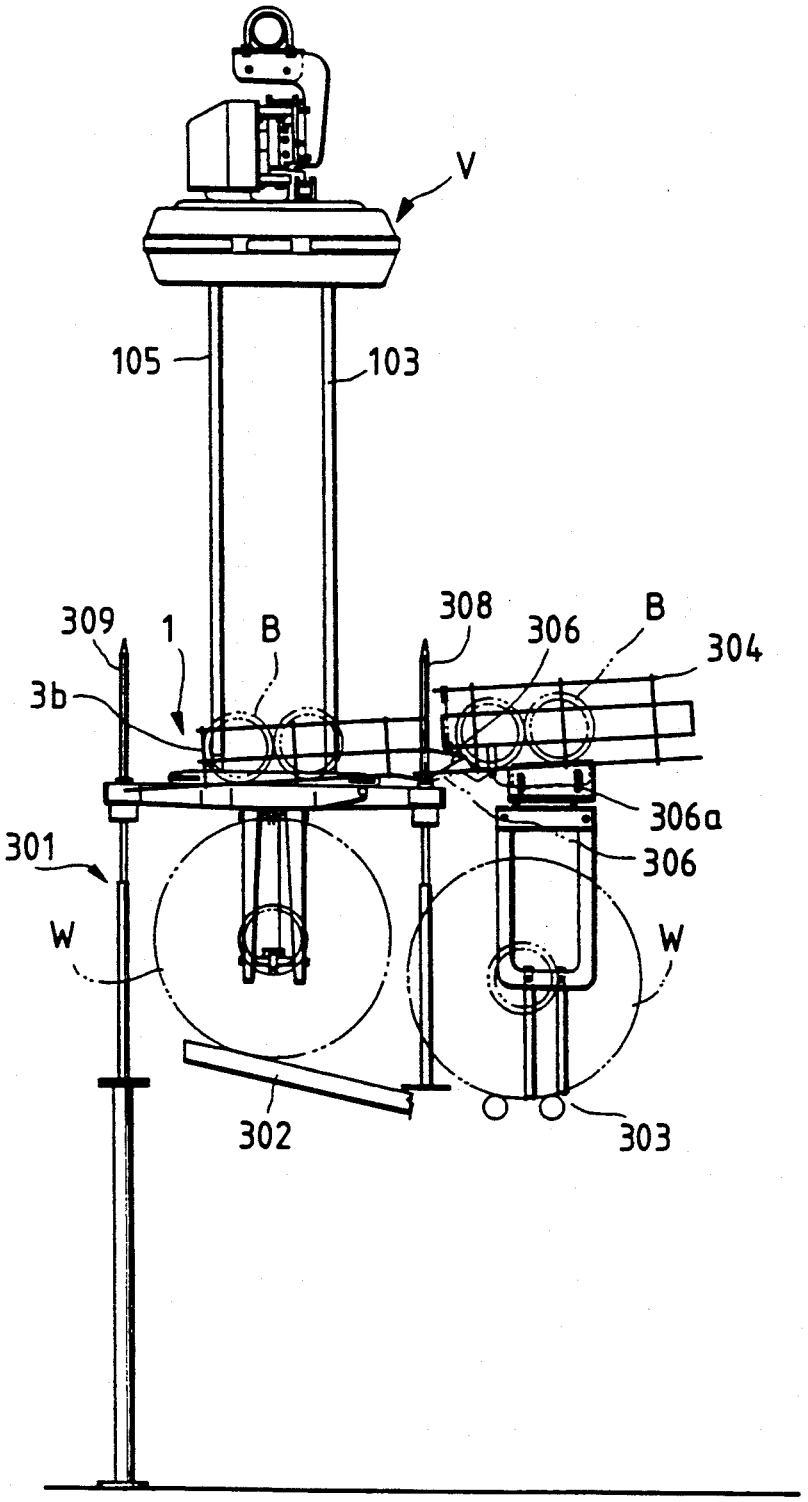

The following description is now provided about the structure of two types of transfer stations. FIGS. 8 to 10 illustrate a spinning bobbin carrying-out/empty bobbin carrying-in station, while FIGS. 11 to 13 illustrate a spinning bobbin carrying-in/empty bobbin carrying-out station.

In FIGS. 8 to 10, a spinning bobbin carrying-out-/empty bobbin carrying-in station 201 is disposed in a position adjacent to a spinning bobbin producing apparatus (not shown). It functions to send out a spinning bobbin to the next step and receive an empty bobbin which has gone through a processing from the next step.

Numeral 202 denotes a spinning bobbin transfer opening for the transfer onto a conveyor 203 of a spinning bobbin which has been fed from the spinning bobbin producing process. Each spinning bobbin W thus transferred onto the conveyor 203 is conveyed to a conveyor 204.

Numerals 206 and 207 are empty bobbin receiving troughs, which are connected to a conveyor 208. At an end portion of the conveyor 208 there are provided a stopper 209, a cylinder 210 and an empty bobbin delivery trough 211. The empty bobbin delivery trough 211 is connected to the spinning bobbin producing process (not shown).

Numerals 212 to 215 denote guide rods, which are tapered at the respective front ends. Numerals 216 and 217 denote abutting rods having abutting pieces 218 and 219 provided at the respective front ends.

Now, a description will be provided below about the transfer operation at the illustrated, spinning bobbin carrying-out/empty bobbin carrying-in station 201.

Spinning bobbins W which have been conveyed from the spinning bobbin producing process are put onto the conveyor 203 at equal intervals through the spinning bobbin transfer opening 202. The spinning bobbins W move rightwards in FIGS. 8 and 9 while retaining uniform, longitudinal intervals, and reach the carrying-out position on the conveyor 204. On the conveyor 204 there are arranged four spinning bobbins W at equal intervals.

The overhead travelling car V travels in a raised state of the bobbin carrier 1 and stops in a position in which the four spinning bobbins W on the conveyor 204 are just under the holding portions **2*a*–2*d* of the bobbin carrier 1, that is, in a position in which the four spinning bobbins are sandwiched in between the respective associated depending portions 50–54. At this time, the baskets 3*a* and 3*b* each contain two empty bobbins B therein. While the overhead travelling car V travels, the holding pieces 55–62** are in a retracted state.

When the overhead travelling car V stops in a predetermined position, the lift mechanism in the overhead travelling car body 102 operates to release the belts 103–106, causing the bobbin carrier 1 to go down. As the bobbin carrier 1 descends, the guide rods 212, 213, 214 and 215 are inserted into the guide holes 98, 99, 100 and 101, whereby accurate positioning is effected.

Figure 14:
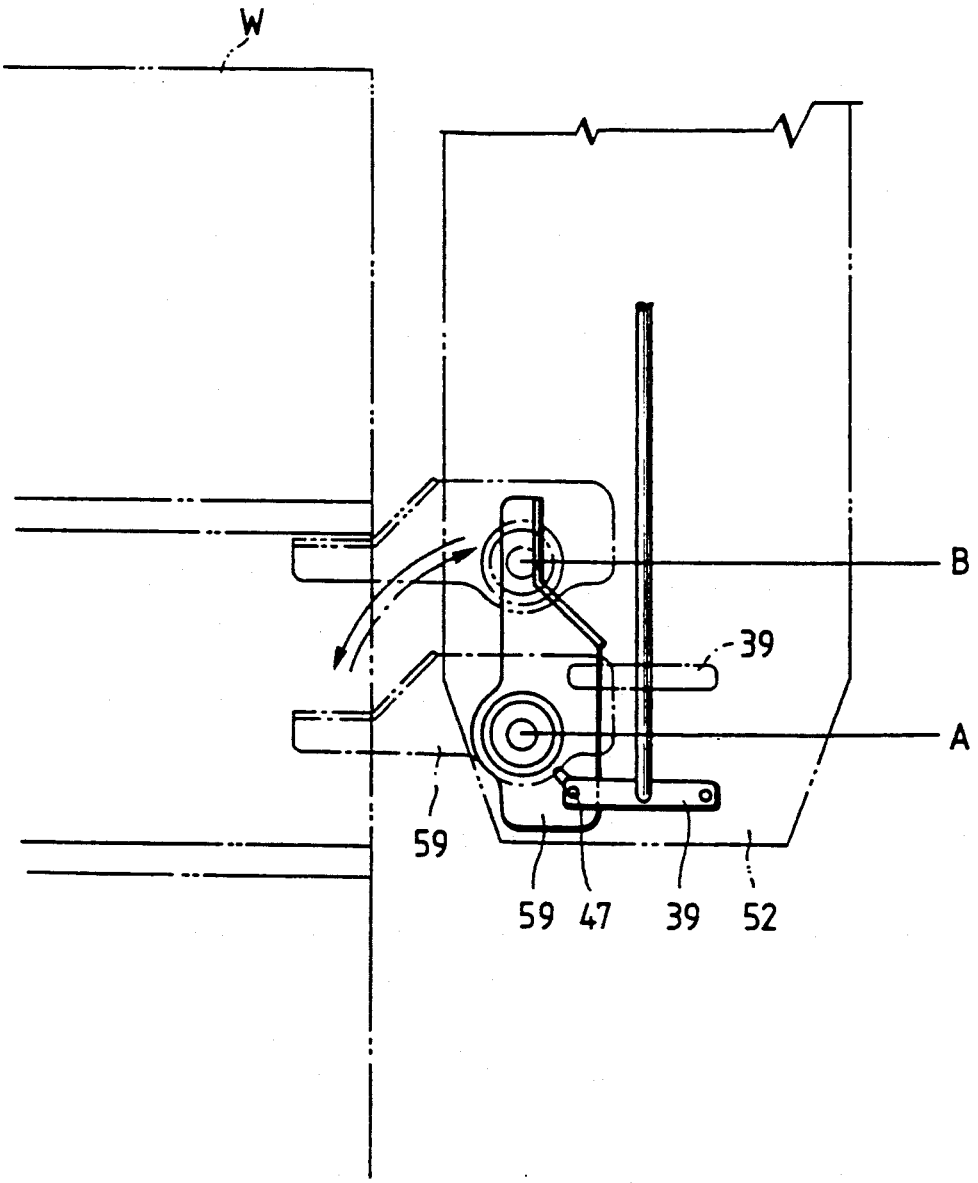
FIG. 14 is a view explanatory of a spinning bobbin holding operation at each of the said stations.

The bobbin carrier 1 goes down until the holding pieces 55–62 reach the height A shown in FIG. 14. In FIG. 14 there is illustrated the operation of only the holding piece 59.

When the holding piece 59 reaches the height A, the holding piece 59 is turned by the forcing holding mechanism and changes its position to that indicated by a dash-double dot line.

Then, the bobbin carrier 1 is pulled up by the lift mechanism of the overhead travelling car V, so that the holding piece 59 rises to the height B to hold the spinning bobbin W.

Further, the bobbin carrier 1 is pulled up to its maximum raised position by the lift mechanism, and the overhead travelling car V holds the spinning bobbin W and starts.

The empty bobbins B in the baskets **3*a* and 3*b* of the bobbin carrier 1 are transferred to the station automatically during the descent of the bobbin carrier 1**.

As shown in FIG. 8, the baskets **3*a* and 3*b* have projecting portions 3*c* and 3*d*, respectively. When the bobbin carrier 1 has descended, the projecting portions 3*c* and 3*d* abut the abutting pieces 218 and 219. Consequently, the baskets 3*a* and 3*b* move in the arrowed direction pivotally about the shaft 96 and tilt. The empty bobbins B localized at the left end portions of the baskets 3*a* and 3*b* roll into the empty bobbin receiving troughs 206 and 207 due to the rightward tilting of the baskets. Then, the empty bobbins B roll on the trough 206 and get on the conveyor 208, whereby the empty bobbins are conveyed leftwards in FIG. 8 until abutment with the stopper 209, whereupon they stop. Thereafter, the empty bobbins B are pushed by the cylinder 210 to the empty bobbin delivery trough 211** and fed to the spinning bobbin producing process.

Thus, at the spinning bobbin carrying-out/empty bobbin carrying-in station 201, both the spinning bobbin carrying-out operation and the empty bobbin carrying-in operation are performed simultaneously.

Now, the structure of a spinning bobbin carrying-in/empty bobbin carrying-out station 301 will be described below.

In FIGS. 11 to 13, the spinning bobbin carrying-in/empty bobbin carrying-out station 301 is provided in a position adjacent to a processing step (not shown) for unwinding and processing the yarn as a semi-finished product which has been fed in a wound-up state on each spinning bobbin. Thus, this station receives spinning bobbins from the preceding step and sends empty bobbins back to the preceding step.

In those figures, numeral 302 denotes an inclined plate for placing thereon each spinning bobbin W which has been carried in. In a lower position the inclined plate 302 is connected to a conveyor 303.

Above the conveyor 303 there are provided two empty bobbin storage baskets 304 and 305. The baskets 304 and 305 are inclined leftwards in FIG. 13 and at their left ends there are provided stoppers 306, 306, 307, 307 to form storage spaces for the empty bobbins B. Their right-hand ends are open. The stoppers 306 and 307 are urged in an upwardly pivoting direction about shafts 306*a*, 306*a*, 307*a* and 307*a* by means of springs (not shown).

Numerals 308 to 311 represent guide rods.

The bobbin transfer operation at the station 301 will be described below.

The overhead travelling car V with four spinning bobbins suspended from the bobbin carrier 1 stop in a predetermined position on the station. At this time, there are no empty bobbins in the baskets 3*a* and 3*b*.

After the stop of the overhead travelling car V, the bobbin carrier 1 goes down. At this time, the guide rods 308–311 are fitted in the guide holes 98–101 of the bobbin carrier 1, whereby accurate positioning can be effected. This is the same as in the station 201.

The bobbin carrier 1 descends until the holding pieces 55–62 reach the height A in FIG. 14. Then, the holding piece 59 located in its dash-double dot line position is turned in the broken-line arrow direction up to its solid line position by the holding mechanism and releases the spinning bobbin W.

The spinning bobbin thus released rolls on the inclined plate 302 and gets on the conveyor 303, whereby it is conveyed to the spinning bobbin processing step.

On the other hand, the empty bobbins B in the empty bobbin storage baskets 304 and 305 are transferred automatically into the baskets 3*a* and 3*b* at the time of descent of the bobbin carrier 1.

When the bobbin carrier 1 descends, projecting portions 3*e*, 3*e*, 3*f*, 3*f* provided at the right-hand end in FIG. 13 of the baskets 3*a* and 3*b* come into abutment with the stoppers 306 and 307, whereby the stoppers 306 and 307 are forced down to the respective positions indicated by dash-double dot lines. Consequently, the empty bobbins B in the empty bobbin storage baskets 304 and 305 are released from the stoppers 306 and 307 and roll into the baskets 3*a* and 3*b*.

In this way, both the spinning bobbin carrying-in operation and the empty bobbin carrying-out operation can be performed simultaneously at the spinning bobbin carrying-in/empty bobbin carrying-out station 301.

According to the bobbin conveying system of this embodiment, as set forth above, the spinning bobbin carrying-out operation and the empty bobbin carrying-in operation are performed at one station, while the spinning bobbin carrying-in operation and the empty bobbin carrying-out operation are conducted at another station, whereby not only the number of stations but also the number of times of start and stop of the automatic travelling car can be decreased but also spinning and empty bobbins can be carried in and out in a simultaneous manner, so that it is possible to save labor and time and attain efficient operation of the system. Also in that the automatic travelling car is prevented from travelling in a no-load condition, the system is rendered efficient.

In the above bobbin transfer work, moreover, since the spinning bobbin carrying-in and -out operation and the empty bobbin carrying-in and -out operation are performed simultaneously and automatically, it is not necessary to make a complicated control.

Although an embodiment of the present invention has been described above, it goes without saying that the present invention is not limited thereto and that modifications may be made within the scope not departing from the gist of the present invention.

According to the bobbin conveying system of the present invention constructed as above, the labor and time of the bobbin transfer operation can be saved and it is possible to realize an efficient operation of the bobbin transfer system. Besides, the automatic travelling car is prevented from travelling in a no-load condition.

What is claimed is:

1. A bobbin conveying system including:

a travelling car for the conveyance of spinning bobbins and empty bobbins, said travelling car including a bobbin carrier fixed to a lift base, a plurality of depending portions supported by the bobbin carrier and holding pieces which are mounted to the depending portions pivotably through shafts, respectively, so that a spinning bobbin is held by the holding pieces at a holding position between the depending portions;

first means for carrying out a spinning bobbin to said automatic travelling car and for carrying in an empty bobbin from said car; and second means for carrying in a spinning bobbin from said automatic travelling car and for carrying out an empty bobbin to said car, wherein the carrying in and carrying out of the spinning bobbin and empty bobbins are performed simultaneously by said first and second means, wherein baskets for receiving empty bobbins therein are pivotably provided on an upper face of the bobbin carrier.

2. A bobbin conveying system as claimed in claim 1, further including a driving mechanism for driving the holding pieces, the driving mechanism comprising a single actuator, a first connecting rod connected to the actuator through a first crank and moved in horizontal direction, a second connecting rod connected to the first connecting rod through a second crank at one end portion thereof to be moved in a vertical direction and a crosshead which is mounted to the other end of the second connecting rod and is connected to one of the holding pieces through a pin so adapted to project the holding piece toward the holding portions.

3. A bobbin conveying system as claimed in claim 2, wherein said holding piece is provided with a stopper pin which may come into abutment with a stopper fixe to the depending portions so that the holding piece kept in a horizontal direction to support a spin bobbin thereby.

* * * * *